US006265702B1

(12) United States Patent
Drozd et al.

(10) Patent No.: US 6,265,702 B1
(45) Date of Patent: Jul. 24, 2001

(54) ELECTROMAGNETIC EXPOSURE CHAMBER WITH A FOCAL REGION

(75) Inventors: J. Michael Drozd; William T. Joines, both of Durham, NC (US)

(73) Assignee: Industrial Microwave Systems, Inc., Morrisville, NC (US)

( * ) Notice: Subject to any disclaimer, the term of this patent is extended or adjusted under 35 U.S.C. 154(b) by 0 days.

(21) Appl. No.: 09/300,914

(22) Filed: Apr. 28, 1999

(51) Int. Cl.[7] ..... H05B 6/78

(52) U.S. Cl. ..... 219/693; 219/699; 219/745; 219/756

(58) Field of Search ..... 219/691, 692, 219/693, 695, 696, 697, 699, 700, 701, 738, 741, 742, 745, 746, 750, 756

(56) References Cited

U.S. PATENT DOCUMENTS

| | | |
|---|---|---|
| Re. 32,664 | 5/1988 | Osepchuk . |
| 2,543,053 | 2/1951 | Parker . |
| 2,612,596 | 9/1952 | Gross . |

(List continued on next page.)

FOREIGN PATENT DOCUMENTS

| | | |
|---|---|---|
| 0 229 708 | 7/1987 | (EP) . |
| 1092861 | 11/1967 | (GB) . |
| 2-265149 | 10/1990 | (JP) . |
| WO98/49870 | 11/1998 | (WO) . |

OTHER PUBLICATIONS

S. Kashyap et al, "A Waveguide Applicator for Sheet Materials," *IEEE Transactions on Microwave Theory and Techniques*, vol. 24, No. 2, Feb. 1976.

Y. Nikawa et al, "A Partially Ferrites Loaded Waveguide Applicator for Local Heating of Tissues," *IEICE Transactions on Communications*, vol. E78–B, No. 6, Jun. 1995.

M. Iskander, "FDTD Simulation of Microwave Sintering of Ceramics in Multimode Cavities," IEEE Transactions on Microwave Theory and Techniques, May 1994, pp. 793–800, vol. 42, No. 5.

R. Lauf, "2 to 18 GHz Broadband Microwave Heating Systems," Microwave Journal, Nov. 1993, pp. 24–34.

A. Van Koughnett, "A Waveguide TEM Mode Exposure Chamber," Journal of Microwave Power, 7(4), 1972, pp. 381–383.

G. Pine, "Comparison of Two–Dimensional Numerical Approximation and Measurement of SAR in a Muscle Equivalent Phantom Exposed to a 915 MHZ Slab–Load Waveguide," Int. Journal of Hyperthermia, vol. 6, No. 1, 1990, pp. 213–225.

(List continued on next page.)

*Primary Examiner*—Philip H. Leung
(74) *Attorney, Agent, or Firm*—Burns, Doane, Swecker & Mathis, L.L.P.

(57) ABSTRACT

An electromagnetic exposure chamber has an exterior conducting surface that forms an interior cavity. The exterior conducting surface has a first substantially planar surface, a second substantially planar surface, a first end, and a second end. The first end has an opening for an electromagnetic wave. The electromagnetic wave forms an electric field. The second end has an elliptical shape that directs the electromagnetic wave to a focal region that extends from the first substantially planar surface to the second substantially planar surface. A second opening through the top surface is aligned with the electromagnetic field. It is possible to pass a material through the second opening. If the opening is aligned with the focal region, the heating is increased. If the opening is aligned with a peak of the electromagnetic wave, the heating is increased and the need for dielectric slabs is decreased. A choke prevents the escape of electromagnetic energy. A third opening allows the continuous flow of a material along a path. If the length of the path is increased, the power density is decreased. If the length of the path is decreased, the power density is increased.

27 Claims, 5 Drawing Sheets

U.S. PATENT DOCUMENTS

| | | | |
|---|---|---|---|
| 2,820,127 | 1/1958 | Argento et al. . | |
| 2,943,174 | 6/1960 | Parker . | |
| 3,281,727 | 10/1966 | Niebuhr et al. . | |
| 3,553,413 | 1/1971 | Soulier . | |
| 3,555,232 | 1/1971 | Bleackley . | |
| 3,594,530 | 7/1971 | Wiegmann et al. . | |
| 3,843,861 | 10/1974 | Van Amsterdam . | |
| 3,848,106 | 11/1974 | Berggren et al. . | |
| 3,934,106 | 1/1976 | MacMaster et al. . | |
| 4,851,630 | 7/1989 | Smith . | |
| 4,940,865 | 7/1990 | Johnson et al. . | |
| 4,999,469 | 3/1991 | Dudley et al. . | |
| 5,142,114 | 8/1992 | Briggs et al. . | |
| 5,173,640 | 12/1992 | Geisler . | |
| 5,371,342 | 12/1994 | Saitoh . | |
| 5,402,672 | 4/1995 | Bradford . | |
| 5,420,390 | 5/1995 | Abe | 219/121.36 |
| 5,432,325 | 7/1995 | Katz et al. . | |
| 5,567,241 | 10/1996 | Tsu . | |
| 5,998,774 | 12/1999 | Joines et al. | 219/745 |
| 6,087,642 * | 7/2000 | Joines et al. | 219/693 |

OTHER PUBLICATIONS

A. Hudson, "Matching the Sides of a Parallel–Plate Region" (letter to editor), IRE Transactions on Microwave Theory and Techniques, Apr. 1957, pp. 161–162.

R. Herren, "An Inhomogeneously Filled Rectangular Waveguide Capable of Supporting TEM Propagation," IEEE Transactions on Microwave Theory and Techniques, Nov. 1971, pp. 884–885.

J. Bernhard et al, "Electric Field Distribution in TEM Waveguides Versus Frequency," Journal of Microwave Power and Electromagnetic Energy, vol. 30, No. 2, 1995, pp. 109–116.

* cited by examiner

10

ELECTROMAGNETIC EXPOSURE CHAMBER WITH A FOCAL REGION

BACKGROUND

The invention relates to electromagnetic energy, and more particularly, to an electromagnetic exposure chamber with a focal region.

The recent popularity of microwaves has led to the discovery of new uses for microwave energy, uses that require an electromagnetic exposure chamber with a relatively uniform power distribution. In some cases, it is advantageous if the material can be passed through—rather than simply placed in—the exposure chamber.

Researchers have experimented with placing a test specimen in a free-space environment between two axially-facing paraboloidal reflectors. See U.S. Pat. No. 3,281,727 to Niebuhr et al entitled "Traveling Wave High Power Simulation." At least one researcher has experimented with using a microwave source in an ellipsoidal shell. See U.S. Pat. No. 2,543,053 to Parker entitled "Radiant Energy High-Temperature Heating Apparatus" and U.S. Pat. No. 2,943,174 to Parker entitled "Radiant Energy Heating Apparatus." These early experiments used bowl-like structures that focus the microwave in multiple directions towards a single point. The problem with these bowl-like structures is that they form a focal point that acts like a single concentrated hot spot. There is poor coupling at the focal point and the energy tends to reflect and scatter. A major concern with the Niebuhr et al patent is that as the waves reflect and scatter, the free space environment cannot contain the electromagnetic energy. A major concern with the Parker patents is that as the waves reflect and scatter, they will propagate towards the source.

There is a need for an electromagnetic exposure chamber that can uniformly focus the electromagnetic energy to a region, rather than a single point, so as to provide more uniform heating. One possible approach is described in our co-assigned and co-pending U.S. patent application Ser. No. 08/813,061 now U.S. Pat. Nos. 5,998,774 and 6,087,642 . In this earlier application, which is herein incorporated by reference, we describe an elliptical structure that focuses the energy in a single plane (or direction). The structure focuses the energy to a focal region that extends from a first substantially planar surface to a second substantially planar surface. The elliptical structure can contain the microwave energy and still allow the material to pass in and out of the chamber.

The disclosed structure can be used with dielectric slabs or without dielectric slabs. In certain instances, the dielectric slabs increase the uniformity across the focal region. However, as the diameter (or width) of the material decreases, the ability to couple the energy into the material also decreases. As a result, it is more difficult to heat the material. As discussed below, it is possible to increase the coupling and, in some instances, decrease the need for the dielectric slabs.

SUMMARY

According to one aspect of the invention, an electromagnetic exposure chamber has an exterior conducting surface that forms an interior cavity. The exterior conducting surface has a first substantially planar surface, a second substantially planar surface, a first end, and a second end. The first end has an opening for an electromagnetic wave. The electromagnetic wave forms an electric field. The second end has an elliptical shape that directs the electromagnetic wave to a focal region that extends from the first substantially planar surface to the second substantially planar surface.

According to another aspect of the invention, an opening through the first surface is a continuously open opening.

According to another aspect of the invention, an opening through the first surface is aligned with the electric field.

According to another aspect of the invention, the opening is aligned with the focal region.

According to another aspect of the invention, the electric field has a peak and the opening is aligned with the peak.

According to another aspect of the invention, the first end has a rectangular opening that has two short sides that connect the first surface and the second surface. The rectangular opening is configured to keep the electromagnetic wave in $TE_{10}$ mode.

According to another aspect of the invention, a continuously open opening has a choke that prevents the escape of electromagnetic energy. The choke surrounds the opening and extends outwardly from chamber's surface.

According to another aspect of the invention, an opening through the second surface is aligned with the opening through the first surface to form a path for the continuous flow of the material.

According to another aspect of the invention, the shape of the exterior cavity is designed to increase the length of the path and decrease the heating density.

According to another aspect of the invention, the shape of the exterior cavity is designed to decrease the length of the path and increase the heating density.

An advantage of the invention is that the electromagnetic wave is uniformly focused to a region, rather than a single point, so as to provide more uniform heating. Another advantage is that more energy is absorbed and the amount of heating is increased. Another advantage is that the need for dielectric slabs is decreased. Another advantage is that it is possible to contain the microwave energy and still allow the material to pass in and out of the chamber. Another advantage is that it is possible to control the power density of the focal region.

BRIEF DESCRIPTION OF THE DRAWINGS

The foregoing, and other objects, features, and advantages of the invention will be more readily understood upon reading the following detailed description in conjunction with the drawings in which.

DETAILED DESCRIPTION

In the following description, specific details are discussed in order to provide a better understanding of the invention. However, it will be apparent to those skilled in the art that the invention can be practiced in other embodiments that depart from these specific details. In other instances, detailed descriptions of well-known methods and circuits are omitted so as to not to obscure the description of the invention with unnecessary detail.

Figure 1:
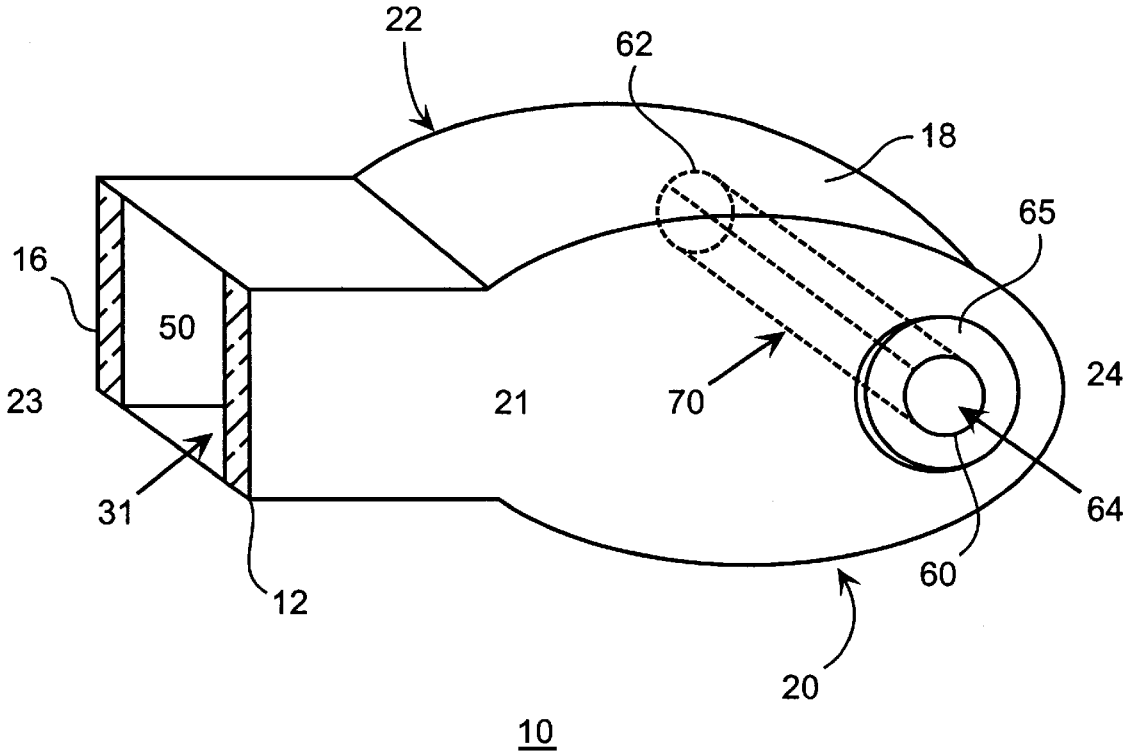
FIG. 1 is an illustration of an electromagnetic exposure chamber with a focal region.

Referring now to FIG. 1, electromagnetic exposure chamber 10 has an exterior conducting surface 20 that has a first substantially planar surface 21, a second substantially planar surface 22, a first end 23, and a second end 24. The exterior conducting surface 20 forms an interior cavity 50. The first end 23 has an opening 31 for delivering an electromagnetic wave to cavity 50. Dielectric slabs 12 and 16 create a more uniform field across chamber 10. A continuous, curved surface 18 directs the electromagnetic wave to a focal region 70. Because elliptical end 24 curves in only one plane (or direction), focal region 70 extends from surface 21 to surface 22. A second opening 60 through surface 21 is aligned with focal region 70. A third opening 62 though surface 22 is also aligned with focal region 70. Opening 60 and opening 62 form a path 64 that allows the materials to pass along the axis of the focal region 70. Choke flange 65 prevents the escape of electromagnetic energy. Opening 60 and opening 62 can be connected with a tube or a dielectric pipe. It will be evident to those skilled in the art that surface 21 and/or surface 22 can be slightly bowed, curved, or fluke shaped without departing from the spirit of the invention.

Figure 2:
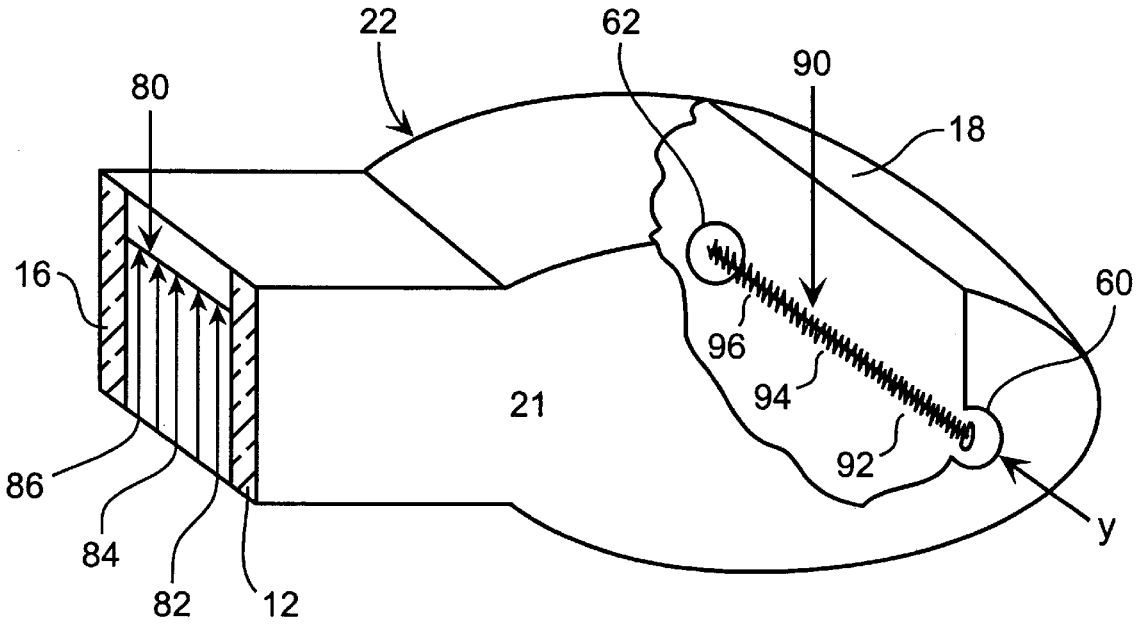
FIG. 2 is an illustration of an electromagnetic field and power densities in FIG. 1.

FIG. 2 is an illustration of an electric field and power densities in FIG. 1. Dielectric slabs 12 and 14 create a more uniform electric field 80 across chamber 10, so that the magnitude of the electric field 80 at points 82 and 86 is equal to or nearly equal to that at point 84. Because the electric field 80 is more uniform across chamber 10, the power densities 90 are more uniform across chamber 10. Opening 60 allows the material to travel in direction y. Because opening 60 is aligned with focal region 70, the material is exposed to a region with the highest power density. However, because opening 60 and direction y are perpendicular to field 80, the material is not aligned with field 80. As the diameter (or width) of the material decreases, the ability to couple electromagnetic energy into the material also decreases. As a result, it is more difficult to heat the material.

Figure 3:
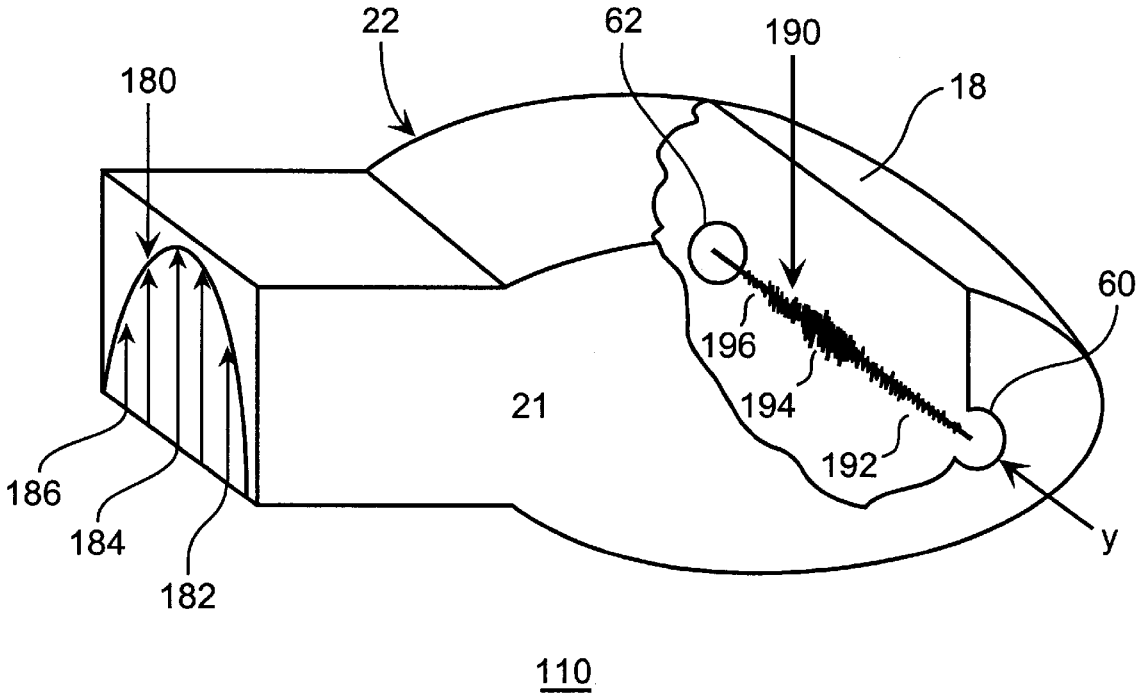
FIG. 3 is an illustration of an electromagnetic field and power densities in FIG. 1, if the dielectric slabs are removed.

FIG. 3 is an illustration of an electromagnetic field and power densities in FIG. 1, if the dielectric slabs are removed. FIG. 3 illustrates the increased need for dielectric slabs, if opening 60 is not aligned with field 180. In FIG. 3, the electromagnetic field 180 across chamber 110 is not as uniform as the field 80 in chamber 10. The magnitude of field 180 at points 182 and 186 is significantly less than the magnitude of field 180 at point 184. Because opening 60 is aligned with focal region 70, the material is exposed to a region with the highest power density. However, because the electromagnetic field 180 is not uniform across chamber 110, the power density 190 is not uniform across chamber 110. Because there is a peak at point 184, there is a hot spot at point 194. If the material travels through opening 60 in direction y, the material is exposed to a low power density at point 192, a high power density at point 194, and a low power density at point 196. FIG. 3 illustrates the increased need for dielectric slabs, if opening 60 is not aligned with field 180.

Figure 4:
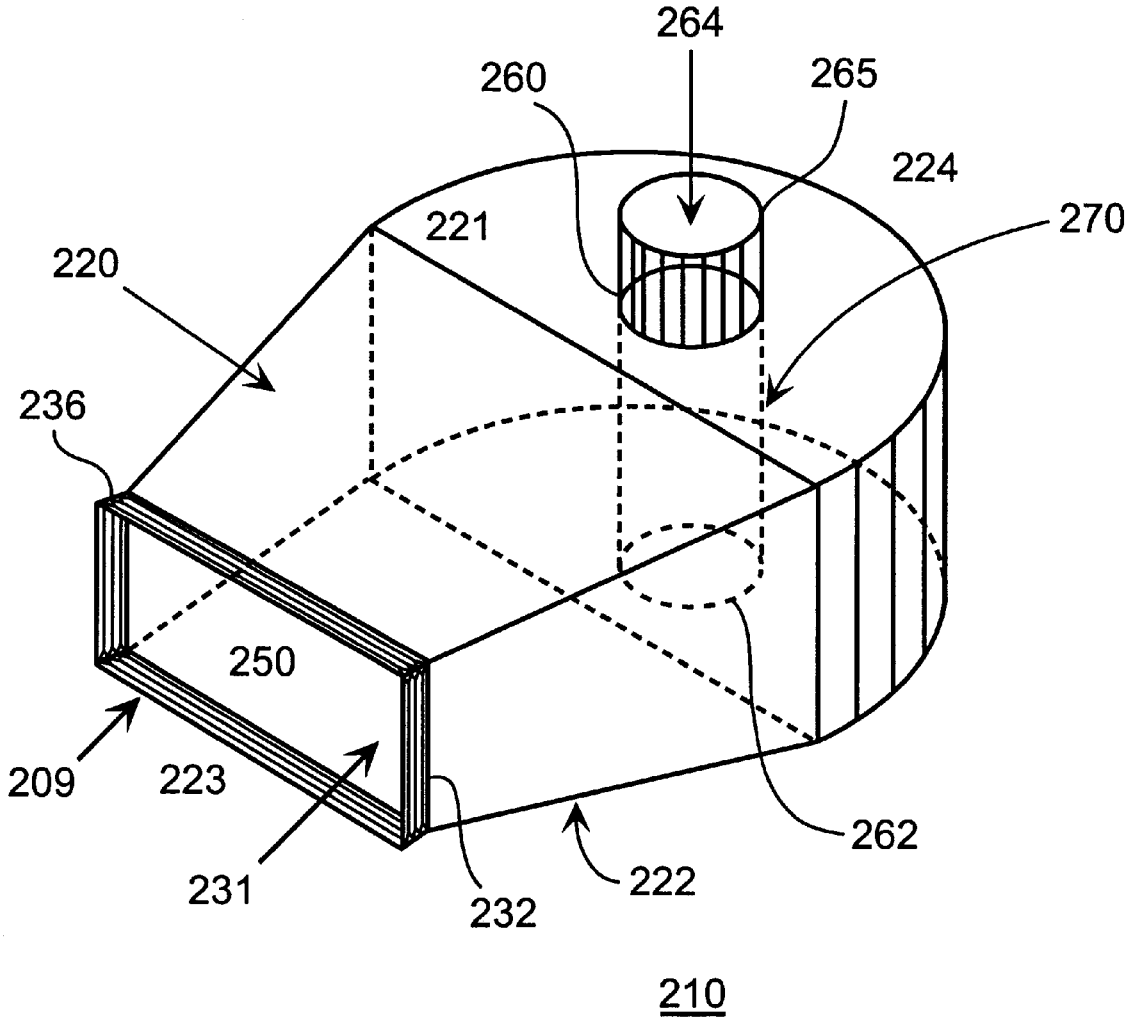
FIG. 4 is an illustration of an electromagnetic exposure chamber with improved coupling.

FIG. 4 is an illustration of an electromagnetic exposure chamber with improved coupling. Electromagnetic exposure chamber 210 has an exterior conducting surface 220 that has a first substantially planar surface 221, a second substantially planar surface 222, a first end 223, and a second end 224. The exterior conducting surface 220 forms an interior cavity 250. The first end 223 has an opening for an electromagnetic wave. The electromagnetic wave forms an electric field (shown in FIG. 5). The second end 224 has an elliptical shape that directs the electromagnetic wave to a focal region 270. Because the second end curves in only one plane (or direction), the focal region 270 extends from surface 221 to surface 222. Chamber 210 has a second opening 260 through surface 221. If the second opening 260 is aligned with the electric field, the ability to couple electromagnetic energy into the material is increased. An impedance matching network 209 matches the impedance of chamber 210 with the impedance of the material, so that less energy is reflected.

If opening 260 is aligned with the focal region 270, the material is exposed to a region with the highest power density. In some applications, it may be advantageous to use an opening that is not aligned with the focal region, but that is connected to a path that is at least in part aligned with the focal region. One way to align opening 260 with the focal region 270 is to position opening 260 an odd multiple of a ¼ of a wavelength of the electromagnetic wave in the interior cavity 250 from the elliptical end 224.

It is usually advantageous to add another opening 262 through the bottom surface 222. If opening 262 is aligned with opening 260 it is possible to pass a material along the axis of focal region 270. Choke 265 prevents the escape of electromagnetic energy through opening 260. The choke 265 surrounds the opening 260 and extends outwardly from surface 221. It is possible to add another choke to opening 262 to prevent the escape of electromagnetic energy through opening 262. Opening 260 and opening 262 can be connected with a tube or a dielectric pipe.

Figure 5:
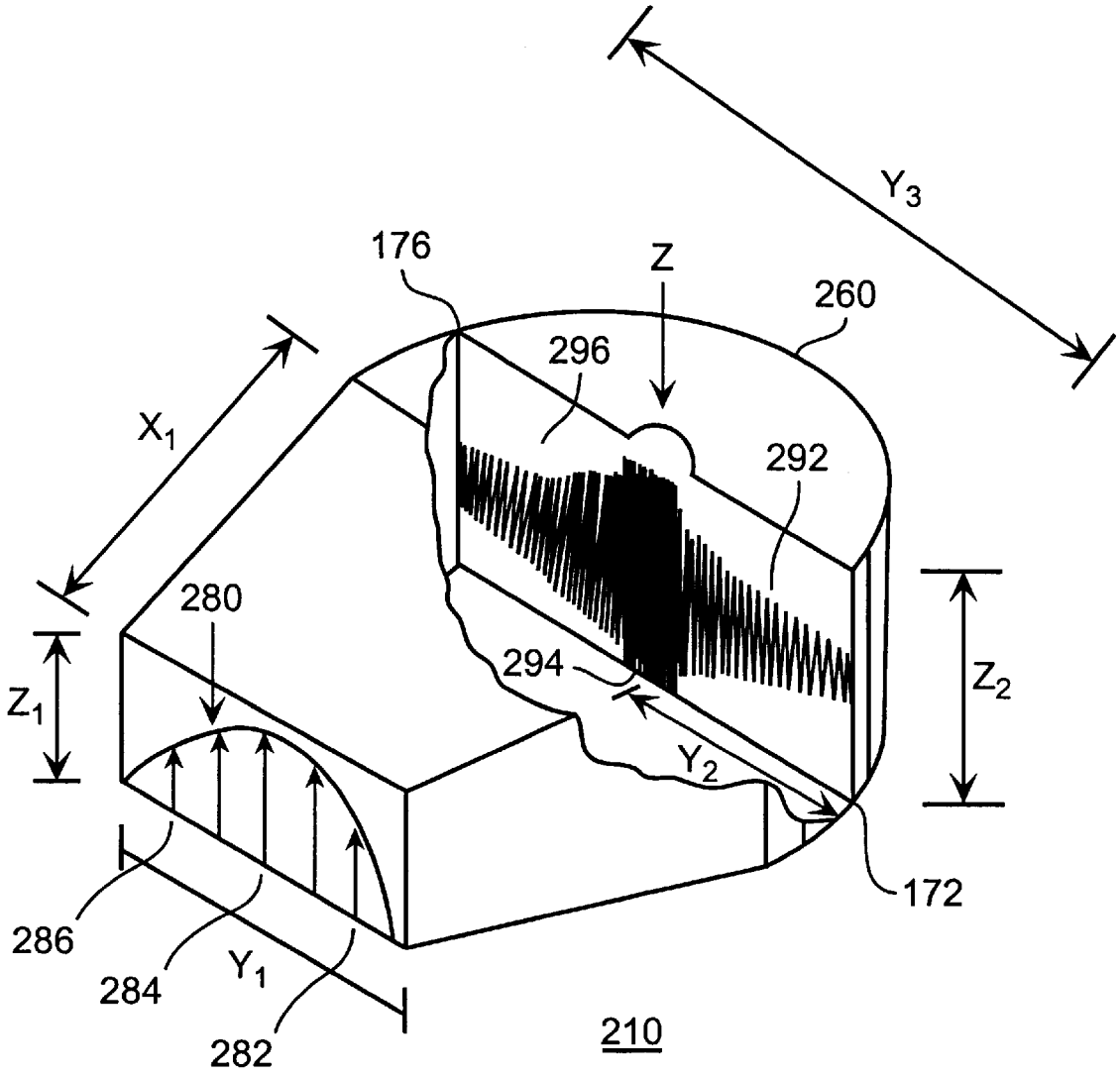
FIG. 5 is an illustration of an electromagnetic field and power densities in FIG. 4.

FIG. 5 is an illustration of an electric field and power densities in FIG. 4. Because opening 260 and direction z are aligned with field 280, the material is aligned with field 280. As a result, the ability to couple energy into the material is increased.

If opening 262 is aligned with peak 284, the material is exposed to a higher power density. One way to align the opening 260 with a peak is to use a rectangular opening 231 that has two short sides 232 and 236. If the short sides 232 and 236 connect surface 221 and surface 222, it is possible to configure the opening 231 so that the electromagnetic wave is in $TE_{10}$ mode. If the wave is in $TE_{10}$ mode, there is a peak halfway between the two short sides 232 and 236.

If a narrow piece of waveguide is used to deliver the electromagnetic wave to opening 231, it is possible to increase the size of opening 260 and/or the relative energy at the circumference of opening 260, by increasing the distance between the two short sides 132 and 136 to a maximum distance ($y_3$) as the distance ($x_1$) from the first end 223 increases, and then decreasing the distance between the two sides 132 and 136 until they meet at the elliptical end 224.

If opening 260 is aligned with focal region 270, the material is exposed to a region with the highest power density. Because the electromagnetic field 280 is not uniform across chamber 210, the power density 290 is not uniform across chamber 210. However, because opening 260 is aligned with field 280, the material can travel along a path that is relatively uniform from surface 221 to surface 222. As long as the material is relatively narrow, it is possible to achieve uniform heating without the additional use of dielectric slabs.

If a narrow piece of waveguide is used to deliver a high power electromagnetic wave to opening 231, it is possible to increase the length of the path 264 (or focal region 294) and at the same time decrease the power density along regions 264 and 294. It is possible to increase the distance $z_2$ between the top surface 221 and the bottom surface 222 and keep the electromagnetic wave in a single mode by gradually increasing the distance $z_2$ until the desired distance is reached. As a result, the distance $z_2$ between the top surface 221 and the bottom surface 222 is greater at end 224, than the distance $z_1$ between the top surface 221 and the bottom surface 222 at end 223.

It is also possible to decrease the length of path 264 (or focal region 294) and at the same time increase the power density along regions 264 and 294. It is possible to decrease the distance $z_2$ between the top surface 221 and the bottom. surface 222 and keep the electromagnetic wave in a single mode by gradually decreasing the distance $z_2$ until the desired distance is reached. As a result, the distance $z_2$ between the top surface 221 and the bottom surface 222 is less at end 224, than the distance $z_1$ between the top surface 221 and the bottom surface 222 at end 223.

While the foregoing description makes reference to particular illustrative embodiments, these examples should not be construed as limitations. For example, the description frequently refers to the flow of a material. However, it will be evident to those skilled in the art that the disclosed invention can be used to sterilize tubing, test tubes, or other materials that are not fluid. The size and shape of the openings can be adjusted accordingly. Thus, the present invention is not limited to the disclosed embodiments, but is to be accorded the widest scope consistent with the claims below.

What is claimed is:

1. An electromagnetic exposure chamber, the chamber comprising;

an exterior conducting surface having a first substantially planar surface, a second substantially planar surface, a first end, and a second end;

the exterior conducting surface forming an interior cavity;

the first end having an opening for an electromagnetic wave, the electromagnetic wave forming an electric field; and the second end having an elliptical shape that directs the electromagnetic wave to a focal region that extends from the first substantially planar surface to the second substantially planar surface;

a second opening through the top surface;

wherein the center of the second opening is positioned near an odd multiple of a ¼ of a wavelength of the electromagnetic wave in the interior cavity from the elliptical end.

2. A device as described in claim 1, the device further comprising an impedance matching network.

3. A device as described in claim 1, wherein the second opening is a continuously open opening.

4. A device as described in claim 1, the second opening aligned with the focal region of the interior cavity.

5. An electromagnetic exposure chamber, the chamber comprising:

an exterior conducting surface having a first substantially planar surface, a second substantially planar surface, a first end, and a second end;

the exterior conducting surface forming an interior cavity;

the first end having an opening for an electromagnetic wave, the electromagnetic wave forming an electric field; and the second end having an elliptical shape that directs the electromagnetic wave to a focal region that extends from the first substantially planar surface to the second substantially planar surface;

a second opening through the top surface, the second opening aligned with the electric field.

6. A device as described in claim 5, wherein the electric field has a peak.

7. A device as described in claim 6, wherein the second opening is aligned with the peak.

8. A device as described in claim 5, the first end having a rectangular opening.

9. A device as described in claim 8, the rectangular opening having two short sides that connect the first surface and the second surface.

10. A device as described in claim 9, the rectangular opening configured so that the electric field has a peak between the two short sides.

11. A device as described in claim 10, the second opening aligned with the peak between the two short sides.

12. A device as described in claim 10, the rectangular opening configured so that the electromagnetic wave is in $TE_{10}$ mode.

13. A device as described in claim 9, wherein a distance between the two shorts sides increases to a maximum distance and then decreases as a distance from the first end increases.

14. A device as described in claim 9, wherein the two short sides meet at the elliptical end.

15. A device as described in claim 14, the center of the second opening halfway between the two short sides.

16. A device as described in claim 5, wherein a choke surrounding the second opening extends outwardly from the top surface.

17. A device as described in claim 16, wherein the second opening is a circular opening.

18. A device as described in claim 17, wherein the choke is a circular choke.

19. A device as described in claim 5, the device further comprising a third opening through the bottom surface.

20. A device as described in claim 19, the third opening aligned with the second opening.

21. A device as described in claim 20, the second opening and the third opening forming a path for the continuous flow of a material.

22. A device as described in claim 21, the material flowing along the axis of the focal region.

23. A device as described in claim 21, wherein the second opening and third opening are connected.

24. An electromagnetic exposure chamber, the chamber comprising:

an exterior conducting surface having a first substantially planar surface, a second substantially planar surface, a first end, and a second end;

the exterior conducting surface forming an interior cavity;

the first end having an opening for an electromagnetic wave, the electromagnetic wave forming an electric field; and the second end having an elliptical shape that directs the electromagnetic wave to a focal region that extends from the first substantially planar surface to the second substantially planar surface;

a second opening through the top surface;

a third opening through the bottom surface, the second opening and the third opening connected to form a path for the continuous flow of a material wherein part of the path is aligned with the axis of the focal region and part of the path is not aligned with the axis of the focal region.

25. An electromagnetic exposure chamber, the chamber comprising:

an exterior conducting surface having a first substantially planar surface, a second substantially planar surface, a first end, and a second end;

the exterior conducting surface forming an interior cavity;

the first end having an opening for an electromagnetic wave, the electromagnetic wave forming an electric field; and the second end having an elliptical shape that directs the electromagnetic wave to a focal region that extends from the first substantially planar surface to the second substantially planar surface;

wherein a distance between the top surface and the bottom surface at the first end is not equal to a distance between the top surface and the bottom surface at the second end.

26. A device as described in claim 25, wherein the distance between the top surface and the bottom surface at the second end is greater than the distance between the top surface and the bottom surface at the first end.

27. A device as described in claim 25, wherein the distance between the top surface and the bottom surface at the first end is greater than the distance between the top surface and the bottom surface at the second end.

* * * * *